US011638847B2

(12) United States Patent
Ito et al.

(10) Patent No.: US 11,638,847 B2
(45) Date of Patent: May 2, 2023

(54) STRETCH EXERCISE TOOL

(71) Applicant: Kabushiki Kaisha SANKEI, Osaka (JP)

(72) Inventors: Maika Ito, Osaka (JP); Michiyo Ito, Osaka (JP)

(73) Assignee: KABUSHIKI KAISHA SANKEI, Osaka (JP)

( * ) Notice: Subject to any disclaimer, the term of this patent is extended or adjusted under 35 U.S.C. 154(b) by 0 days.

(21) Appl. No.: 17/409,329

(22) Filed: Aug. 23, 2021

(65) Prior Publication Data

US 2022/0062681 A1 Mar. 3, 2022

(30) Foreign Application Priority Data

Aug. 26, 2020 (JP) ..... JP2020-142858

(51) Int. Cl.
*A63B 21/055* (2006.01)
*A63B 21/00* (2006.01)
*A63B 23/00* (2006.01)

(52) U.S. Cl.
CPC ..... *A63B 21/0552* (2013.01); *A63B 21/4035* (2015.10); *A63B 2023/006* (2013.01)

(58) Field of Classification Search
CPC ..... A63B 21/0552; A63B 21/4035; A63B 2023/006
See application file for complete search history.

(56) References Cited

U.S. PATENT DOCUMENTS

| | | | | |
|---|---|---|---|---|
| 4,762,318 | A | 8/1988 | Phillips | |
| 5,715,578 | A | 2/1998 | Knudson | |
| 8,343,018 | B2 * | 1/2013 | Moulton | A63B 23/035 482/131 |
| 9,272,178 | B2 * | 3/2016 | Pinder | A63B 21/4025 |
| 2007/0265145 | A1 | 11/2007 | Teng | |
| 2008/0081746 | A1 | 4/2008 | Woodruff | |
| 2014/0024508 | A1 * | 1/2014 | Hinds | A63B 21/00043 482/129 |
| 2015/0072840 | A1 | 3/2015 | Poe | |
| 2018/0272177 | A1 | 9/2018 | Negron | |

FOREIGN PATENT DOCUMENTS

| | | | |
|---|---|---|---|
| JP | S49-059659 | U | 5/1974 |
| JP | S60-092553 | U | 6/1985 |
| JP | 3036979 | U | 5/1997 |
| JP | 3100756 | U | 5/2004 |
| JP | 3101194 | U | 6/2004 |
| JP | 2005-040209 | A | 2/2005 |
| JP | 2006-325634 | A | 12/2006 |
| JP | 2009-219659 | A | 10/2009 |
| JP | 3197086 | U | 4/2015 |
| JP | 1566902 | S | 1/2017 |
| JP | 1570540 | S | 2/2017 |
| JP | 2017-209514 | A | 11/2017 |
| JP | 2019-103538 | A | 6/2019 |
| WO | 2011/065883 | A1 | 6/2011 |

* cited by examiner

*Primary Examiner* — Andrew S Lo
(74) *Attorney, Agent, or Firm* — Kratz, Quintos & Hanson, LLP

(57) ABSTRACT

A stretch exercise tool having both ends of a band that can adjust a use length passed through a pair of fittings in a retaining state, and a root portion of a stretchable elastic ring is sandwiched by the fittings in the retaining state.

8 Claims, 20 Drawing Sheets

STRETCH EXERCISE TOOL

BACKGROUND

Technical Field

The present invention relates to a stretch exercise tool useful for rehabilitation, adjustment of muscles, correction of skeletons (postures), and the like, as well as promotion of blood flow to capillaries.

Related Art

As tools to be used for exercise such as stretching and muscle training, there are two types of known tools: a tool having a configuration in which a pair of grips held by a user is attached to both ends of a stretchable member having a constant length such as a rubber tube, a rubber string, or a coil spring as described in JP 2019-103538 A and Japanese Utility Model Registration No. 3101194, and a tool having a configuration in which a grip held by a user is attached to one end of a stretchable member similarly having a constant length and a fitting to a body is attached to the other end as described in JP 2009-219659 A, JP 2006-325634 A, JP 2005-40209 A, and Japanese Utility Model Registration No. 3036979.

CITATION LIST

Patent Literature

Patent Literature 1: JP 2019-103538 A
Patent Literature 2: Japanese Utility Model Registration No. 3101194
Patent Literature 3: JP 2009-219659 A
Patent Literature 4: JP 2006-325634 A
Patent Literature 5: JP 2005-40209 A
Patent Literature 6: Japanese Utility Model Registration No. 3036979

SUMMARY

Capillaries are parts that transit from arteries to veins, and deliver necessary oxygen and nutrients to cells and collect unnecessary carbon dioxide and waste products. However, since the capillaries are extremely narrow, if retention or clogging of a blood flow (venous blood) occurs, the blood does not reach the ends, easily causing cooling, swelling, and the like.

In addition, aging and deterioration of capillaries declines the functions of organs that deliver blood and immunity, leading to various disorders and diseases of the body, and thus activation of the capillaries has been focused in recent years. Capillaries are concentrated in limbs and fingers and toes, and massaging (stimulating) the periphery to improve blood circulation is useful for improving the blood circulation in the whole body.

In this regard, in the configuration of the exercise tool disclosed in JP 2019-103538 A, Japanese Utility Model Registration No. 3101194, JP 2009-219659 A, JP 2006-325634 A, JP 2005-40209 A, and Japanese Utility Model Registration No. 3036979, even when the stretchable member is extended by receiving a tensile force, the elastic force of the stretchable member does not directly act on the grip or the hand holding the grip. Since the grip itself does not have stretchability or elasticity, the hand holding the grip or its fingers may be rigidly and strongly tightened or excessively compressed. In such a case, the blood flow of the hand or the fingers deteriorates, leading to decline in the capillary functions.

Any of the exercise tools disclosed in JP 2019-103538 A, Japanese Utility Model Registration No. 3101194, JP 2009-219659 A, JP 2006-325634 A, JP 2005-40209 A, and Japanese Utility Model Registration No. 3036979 is useful for the training of muscle strengthening by holding and pulling the grips with both hands similarly to an expander, but is not useful at all for promoting the peripheral blood flow and improving the blood circulation by giving repetitive stimulation of elastic compression and release to the hands or fingers holding the grips.

An object of the present invention is to drastically address such an issue, and as a stretch exercise tool for achieving the object, in claim 1, the stretch exercise tool includes a non-stretchable flexible band capable of adjusting a use length, and stretchable elastic rings attached to both ends of the band via a pair of fittings, in which each of the elastic rings is sliced by a constant width of a rubber or thermoplastic elastomer tube as a cylindrical body, a plurality of finger hook rings is divided and formed by slits cut to a depth not reaching from one end of a circumferential surface of the cylindrical body having the constant width to the other end facing by 180 degrees, and the other end of the circumferential surface remaining without being divided is sandwiched in a retaining state by the fitting as a root portion of a continuous single piece common to the plurality of finger hook rings.

In claim 2, a total of five first to fifth finger hook rings arranged in parallel are divided and formed by cutting four slits substantially in parallel into the cylindrical body having the constant width in each of the elastic rings.

In claim 3, the root portion of the continuous single piece common to the plurality of finger hook rings is wound around a core rod longer than the constant width of the cylindrical body, and the core rod around which the root portion is wound is sandwiched in the retaining state by the fitting.

In claim 4, the widths of the plurality of finger hook rings are all equal, or are varied widely or narrowly in accordance with the change in the thickness of the finger in the limb.

In claim 5, the cut depths of the slits dividing and forming the plurality of finger hook rings are all equal or are varied deeply or shallowly in accordance with a change in length of a finger in a limb.

In claim 6, each of the fittings is formed of a fitting body board and a lid board having a same size and shape and fastened and fixed by a plurality of fixing screws, a through hole of the band is penetrated and formed on one end side with a fixing position by the fixing screws as a boundary, and on the other end side with the fixing position by the fixing screws as the boundary, recessed grooves that communicate with each other to form a blind hole is notched and formed in a manner that the root portion of the continuous single piece common to the plurality of finger hook rings can be sandwiched in the retaining state.

In claim 7, the elastic rings are determined to be detachable and replaceable in an attached state in which the band is passed through the fitting body board and the lid board by removing the fixing screws fastening and fixing the body board and the lid board of the fitting.

Further, in claim 8, the body board and the lid board of the fitting are made of a light alloy, another metal, a fiber-reinforced resin, or another high-strength synthetic resin that are made of the same material.

According to the above configuration of claim 1, the stretchable elastic rings attached to both ends of the non-stretchable band via a pair of fittings are hooked on the hands or feet of a user in a wound state (a state in which the hands or feet are passed through the elastic rings), and a large or small tightening force (load) adjusted by the strength of force pulling the elastic rings is applied to the hands or feet. Further, the elastic compression force is applied to the capillaries of the hands and feet, and the blood flow is promoted to improve the blood circulation of the capillaries.

That is, when the stretchable elastic rings are strongly pulled, the hands and feet hooked on in the wound state are tightened, and the blood vessels are compressed. On the other hand, when the pulling is returned to the original state, the tightening force of the hands and feet is weakened, and the compression of the blood vessels is released. Therefore, the effect of promoting the blood circulation can be obtained by the stimulation of repeating this motion instantaneously.

In this case, since the elastic ring is branched as a plurality of finger hook rings by the slits (split grooves) sliced into the cylindrical body by a constant width of the tube made of rubber or thermoplastic elastomer, the finger hook rings having stretchability and rubber-like elasticity can be hooked one by one separately on the finger or toe of the user, and the repetitive stimulation of compression and release can be applied to tip of each finger and toe to further improve the blood circulation of the capillaries more favorably.

In addition, the root portion of the plurality of finger hook rings remaining without being divided is sandwiched in a retaining state by the fitting as a continuous single piece. Therefore, the attachment work of the finger hook rings to the fitting can be quickly and easily performed, the attached state is orderly and stable, and the finger hook rings can be smoothly hooked on each finger and toe.

In addition, the finger hook rings of the elastic ring to be hooked on hands and feet of a user is made of a material having stretchability and rubber-like elasticity, unlike the grip of the related art described at the beginning. Therefore, even if a user strongly pulls the finger hook rings, there is no risk of rigidly tightening and hurting the hands and fingers or damaging the skin, and the stretch exercise tool can be used safely.

Furthermore, although a non-stretchable flexible band is used, since the use length can be adjusted to be long or short in accordance with the user's physique (height), the intended exercise, and the like, the tensile force of the elastic rings can be adjusted to be strong or weak, and it is useful to constantly apply an appropriate load to the user's body or a part to be the purpose (target).

When the configuration of claim 2 is adopted, since the finger hook ring is divided and formed into a total of five finger hook rings corresponding to five fingers or toes, the first to fifth finger hook rings can be one by one separately hooked and used on the five fingers or toes. The stimulation of compression and release can be given to each finger or toe to obtain the effect of promoting the blood circulation.

When the configuration of claim 3 is adopted, the root portion of the continuous single piece common to the finger hook rings of the elastic ring can be sandwiched in a reliable retaining state by the fitting as a stable state in which the root portion is wound around the core rod (stopper pin), and there is an effect that the work can be easily performed.

If the configuration of claim 6 is adopted, a pair of fittings for connecting the non-stretchable band and the stretchable elastic rings so to speak, includes one set of a fitting body board and a lid board having the same size and shape with each other, and is fastened and fixed by a plurality of fixing screws. A through hole of the band is formed on one end side from a fixing position by the fixing screws, and recessed grooves serving as a blind hole for sandwiching the root portion of the elastic ring is formed on the other end side similarly from the fixing position in a divided state so to speak. Therefore, the pair of fittings can be easily processed and assembled, and the mass productiveness is excellent.

When the configuration of claim 7 is adopted, it is possible to detach and replace only the elastic ring that is most likely to be worn while the band is in the attached state of being passed through the fitting, and the stretch exercise tool can be used for a long time.

When the configuration of claim 8 is adopted, the weight can be reduced without deteriorating the strength of the fittings, and the stretch exercise tool is easily used even more.

DETAILED DESCRIPTION

Figure 1:
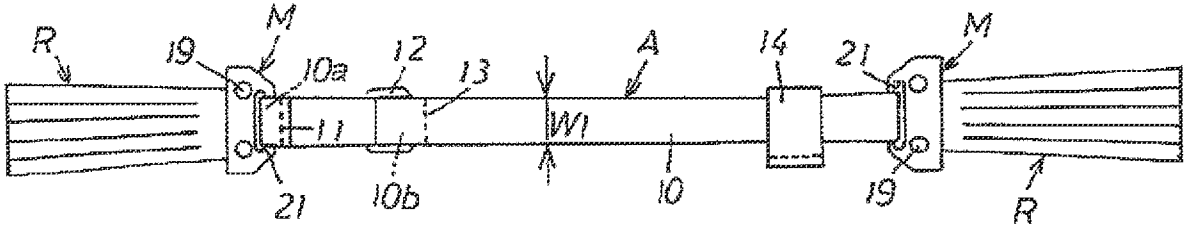
FIG. 1 is a front view of a stretch exercise tool according to a preferred embodiment of the present invention.
Figure 2:
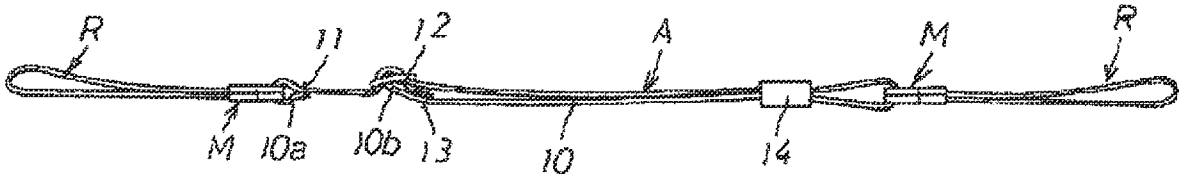
FIG. 2 is a plan view of FIG. 1.

Hereinafter, a preferred embodiment of the present invention will be described in detail with reference to the drawings. FIGS. 1 and 2 illustrate the overall view of a stretch exercise tool (A) according to the embodiment, and FIGS. 3 to 6 are enlarged views illustrating a part of the stretch exercise tool (A).

In FIGS. 1 to 6, (10) is a band (belt) of the stretch exercise tool (A), and is made of a fabric (woven fabric) or other non-stretchable flexible materials. As such a material, string, leather, and the like are conceivable, but it is preferable to adopt the band (10) of a textile product such as the above fabric (woven fabric) because the band (10) smoothly fits, bends, and deforms along the body of the user, and stably comes into contact with the surface of the body as a flat belt shape having a constant width (W1). The band (10) in the illustrated examples has the band width (W1) of about 2.5 to 3.0 cm.

(M) is a pair of elastic ring fittings formed of light alloy (desirably, an aluminum alloy), brass, stainless steel, other non-rusting metal, a fiber-reinforced resin (FRP), or other high-strength synthetic resin. As is apparent from FIGS. 1 and 2, one end (10*a*) of the band (10) is fixed by a sewing thread (11) in a state of being passed through and wound around one of the fittings (M), and then the other end (10*b*) of the band (10) that goes through a buckle (12) and is passed through the other fitting (M) and turned back is fixed by a sewing thread (13) in a state of being wound around the buckle (12). (14) is a sleeve (sheath ring) slidably passed through into the overlapping folded-back portion of the band (10).

That is, the use length of the band (10) can be adjusted to be long or short by the buckle (12) in accordance with the physique (height) of the user, the target exercise, and the like. The band (10) having the band width (W1) in the illustrated example has a specification in which the use length can be adjusted within a certain range from the shortest dimension of about 30 cm to the longest dimension of about 55 cm.

Figure 3:
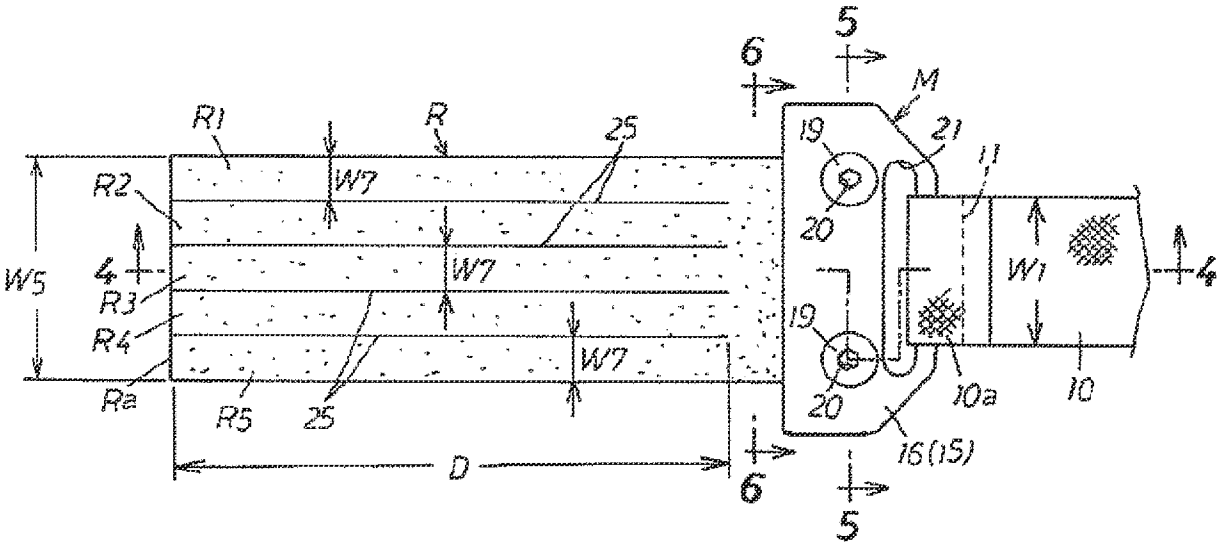
FIG. 3 is an enlarged view illustrating a part of FIG. 1.
Figure 4:
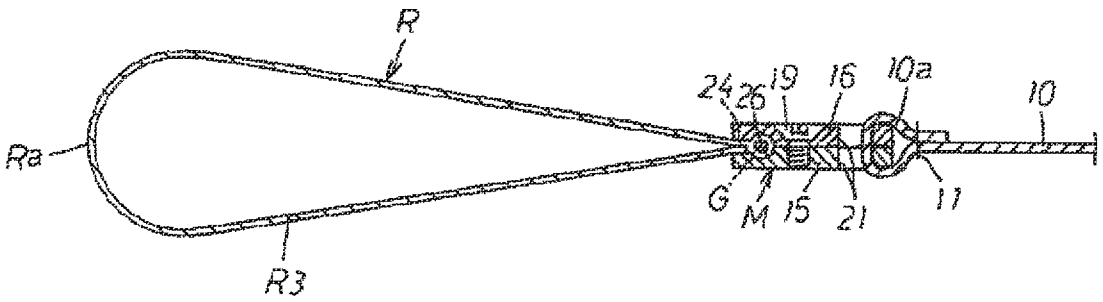
FIG. 4 is a cross-sectional view taken along line 4-4 in FIG. 3.
Figure 5:
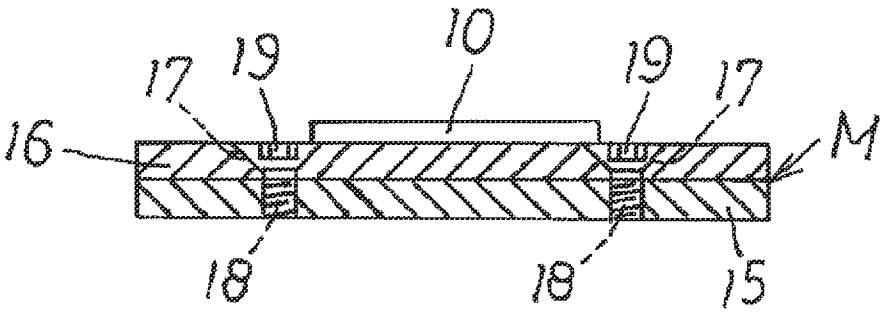
FIG. 5 is a cross-sectional view taken along line 5-5 in FIG. 3.

Each of the fittings (M) includes a set of a fitting body board (15) and a lid board (16) having the same size and shape with each other. As illustrated in FIGS. 3 to 5, the fittings (M) are detachably fastened and fixed by fixing screws (19) that are screwed from a plurality of (two in the illustrated examples) fixing screw receiving holes (17) distributed in the opening of the middle part of the lid board (16) to screw holes (18) formed corresponding to the middle part of the fitting body board (15). For the fixing screws (19), it is preferable to adopt countersunk screws as in the illustrated examples.

(20) is a hexagonal hole for locking a pivoting tool (hexagonal bar wrench) notched in the countersunk head of each of the fixing screws (19), but a cross shaped or straight recessed portion (not illustrated) for locking a pivoting tool (screwdriver) may be provided instead of the hexagonal hole. Further, fixing screws such as pan head or round head screws and screw receiving holes (not illustrated) may be adopted instead of the fixing screws (countersunk screws) (19) and the fixing screw receiving holes (countersunk holes) (17).

In the fitting body board (15) and the lid board (16), as is apparent from FIGS. 4 and 9 to 11, a through hole (21) for the band (10) is penetrated and formed in an elongated manner on one end side with the fixing position by the fixing screws (19) as a boundary, and a recessed groove (22) having a semicircular cross section is also notched and formed in an elongated manner on the other end side with the fixing position by the fixing screws (19) as a boundary in the similar way.

The recessed groove (22) on the fitting body board (15) side and the recessed groove (22) on the lid board (16) side are in a corresponding positional relationship facing each other, and in a state of being fastened and fixed by screwing the fixing screws (19), the recessed grooves (22) communicate with each other to form a blind hole (G) having a circular cross section as illustrated in FIG. 4 inside the fitting (M), in a manner that the root portion of the elastic ring and its core rod (stopper pin) to be described later can be held in a state of being retained in the fitting (M).

In this case, as illustrated in FIGS. 6 and 9 to 11, each of the through hole (21) passing the band and the recessed grooves (22) forming the blind hole (G) in the fitting (M) are elongated and extend parallel along the width direction of the band (10), and a length (W2) (5.5 cm in the illustrated examples) of the recessed grooves (22) is notched longer than a length (W3) (3.5 cm in the illustrated examples) of the through holes (21).

(23) is a recessed step surface formed by notching the end edge on the other end side of the fitting body board (15) and the lid board (16) as a length (W4) (5 cm in the illustrated examples) shallower than the notch depth of the recessed groove (22) having a semicircular cross section and slightly shorter than the length (W2) of the recessed groove (22), and is adjacent to and opened to be communicated with to the recessed groove (22).

Figure 6:
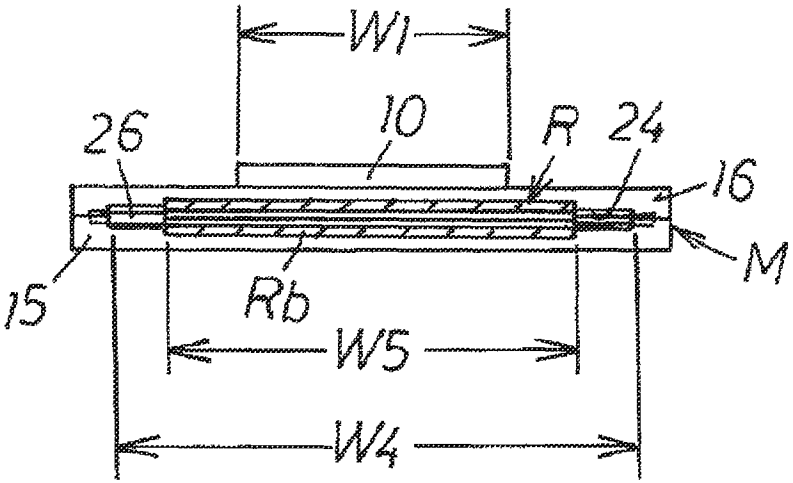
FIG. 6 is a cross-sectional view taken along line 6-6 in FIG. 3.

The recessed step surface (23) on the fitting body board (15) side and the recessed step surface (23) on the lid board (16) side are in a corresponding positional relationship facing each other, and in a state of being fastened and fixed by screwing the fixing screws (19), the recessed step surfaces (23) communicate with each other to define and form an elongated lead-out window (24) of the elastic ring described later as illustrated in FIGS. 4 and 6 in the fitting (M).

Figure 7:
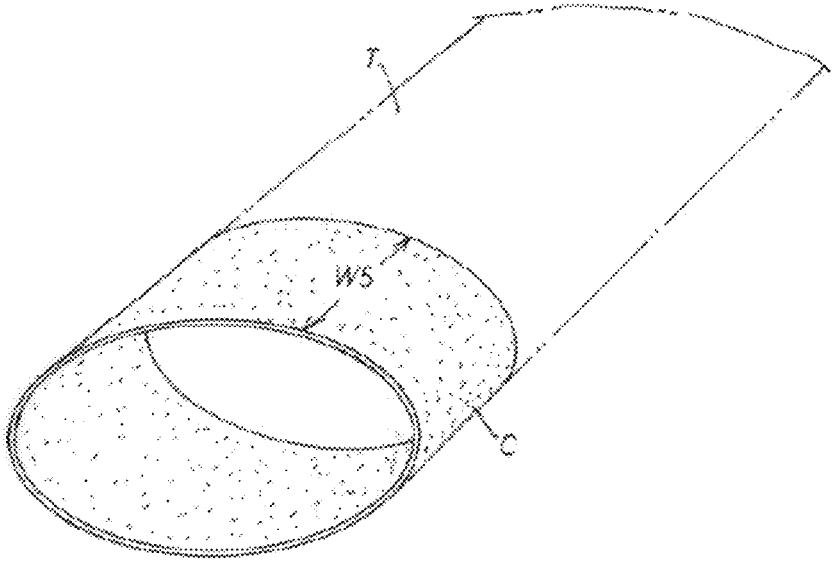
FIG. 7 is an inclined view illustrating a cylindrical body sliced from a tube that is a material of an elastic ring.

Further, (R) is a pair of stretchable elastic rings, and each of the elastic rings is formed of a cylindrical body (C) obtained by slicing a tube (T) rich in stretchability and rubber-like elasticity, such as rubber or a thermoplastic elastomer (TPE) like polystyrene type, polyester type, or olefin type, into rings having a necessary constant width (W5) as suggested in FIG. 7. In the case of the illustrated example, the thickness of the cylindrical body (C) is about 1.0 to 1.5 mm, the constant width (W5) of the cylindrical body (C) is about 4 cm, and a length (L) of the cylindrical body (C) in a polymerized state where the cylindrical body (C) is pressed flat is about 12 cm.

Figure 8:
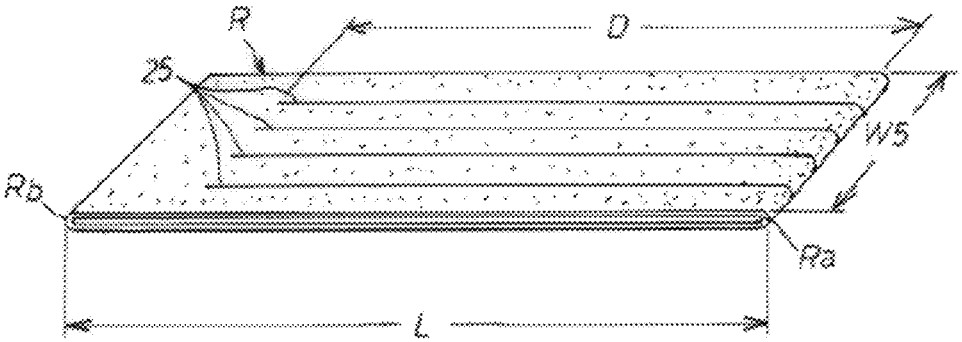
FIG. 8 is an inclined view of the elastic ring in which a plurality of finger hook rings are divided and formed by pressing the cylindrical body in FIG. 7 flat and by cutting slits (split grooves)

In addition, as suggested in FIGS. 3 and 8, slits (split grooves) (25) having an appropriate depth (D) (about 10 cm in the illustrated examples) that do not reach from one end (Ra) of the circumferential surface to the other end (Rb) of the circumferential surface facing by 180 degrees in the elastic ring (R) including the cylindrical body (C) of the constant width (W5) are cut and arranged in a row. Thus, the elastic ring (R) of the cylindrical body (C) is divided and formed (branched) into a plurality of finger hook rings (R1), (R2), (R3), (R4), and (R5) in an overall parallel state.

In the illustrated examples, the four slits (25) are arranged substantially in parallel and a total of the five finger hook rings (R1) to (R5) are arranged in a row. These first to fifth finger hook rings (R1) to (R5) can be separately hooked and used on the first to fifth fingers of hands and first to fifth toes of feet of the user. However, it is needless to say that the total of five first to fifth finger hook rings (R1) to (R5) can be hooked and used in a state of being wound around a hand or a foot as a bundled state in which the five finger hook rings (R1) to (R5) are integrated into one ring shape or a bundled state in which an appropriate plurality number of finger hook rings such as five or less is integrated into one ring shape (a state in which a hand or a foot is passed through into the integrated finger hook rings).

The other end (Rb) remaining without being divided as the plurality of finger hook rings (R1) to (R5) in the cylindrical body (C) is inserted and set together with their core rod (stopper pin) (26) into the recessed grooves (22) serving as the blind hole (G) of the fitting (M) as a root portion of the continuous single piece common to the plurality of finger hook rings (R1) to (R5), and is held in the state of being retained in the fitting (M) when the fitting (M) is fastened and fixed by the fixing screws (19).

Figure 9:
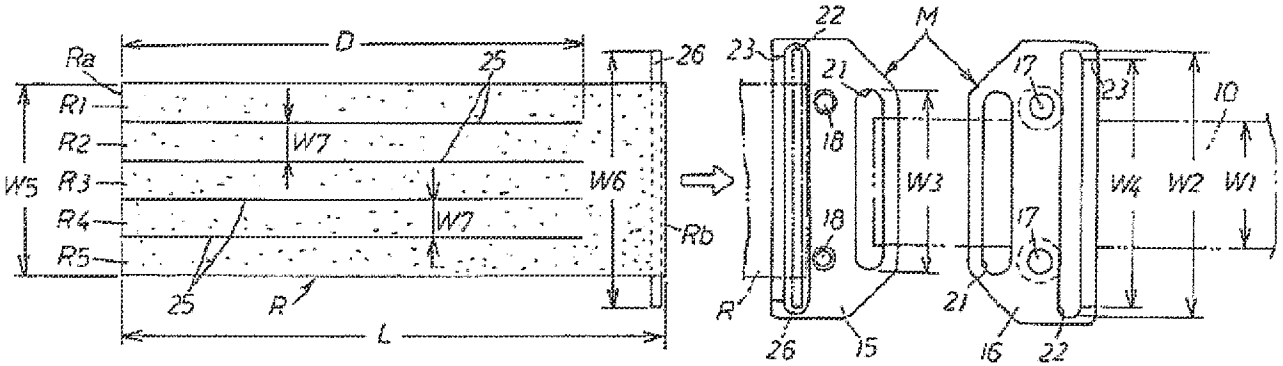
FIG. 9 is a front view for explaining a process of assembling from a disassembled state in FIG. 3.
Figure 10:
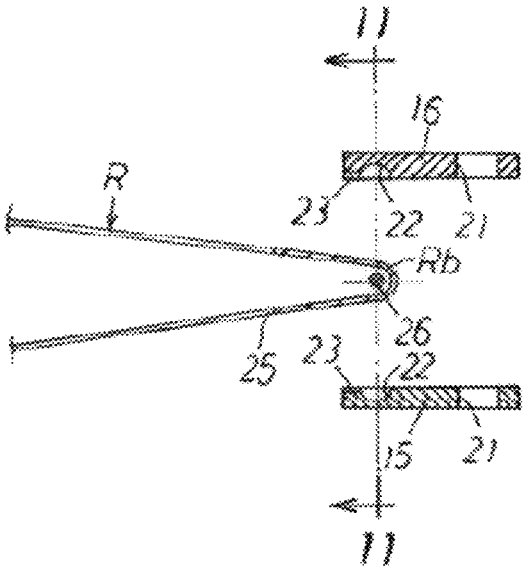
FIG. 10 is a side sectional view illustrating a corresponding positional relationship between an elastic ring fitting in the disassembled state and the elastic ring.
Figure 11:
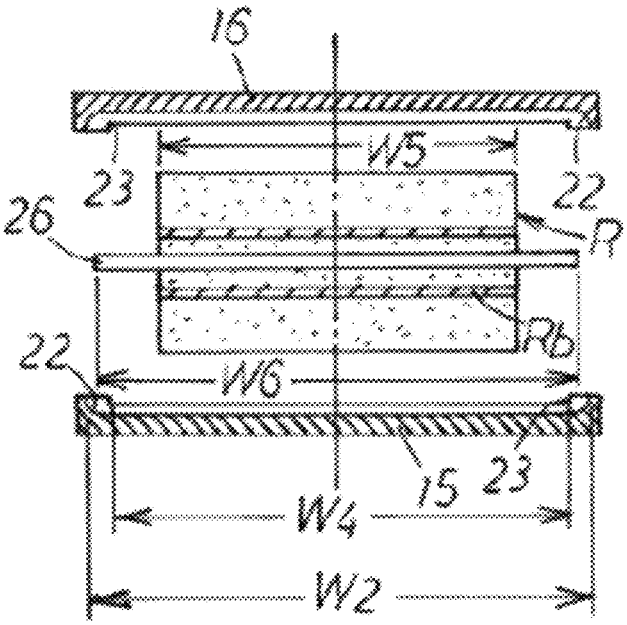
FIG. 11 is a cross-sectional view taken along line 11-11 in FIG. 10.

The core rod of each of the finger hook rings (R1) to (R5) is shorter than the length (W2) (5.5 cm as exemplified above) of the recessed grooves (22) in the fitting (M), and is made of a metal wire material (piano wire) or a round rod (steel rod) having a constant length (W6) (5.3 cm in the illustrated examples) longer than the length (W4) (5 cm as exemplified above) of the recessed step surfaces (23) forming the lead-out window (24) for the elastic ring and an appropriate constant thickness (diameter of 1.5 to 2.0 mm in the illustrated examples). As illustrated in FIGS. 9 to 11, the core rod (stopper pin) (26) is inserted and set into the recessed grooves (22) on the fitting body board (15) side in a traversing state of being passed through in the root portion (Rb) of the finger hook rings (R1) to (R5) (in a state in which the root portion is wound around the core rod). When the lid board (16) is fastened and fixed from above by the fixing screws (19), the core rod (stopper pin) (26) is held in the blind hole (G) having a circular cross section facing and communicating with the recessed grooves (22) on the lid board (16) side as illustrated in FIG. 4, and sandwiched in a retaining state by the fitting (M).

Only the finger hook rings (R1) to (R5) having the root portion (Rb) sandwiched between the fitting body board (15) and the lid board (16) of the fitting (M) are led out without any issue from the lead-out window (24) of the fitting (M) as illustrated in FIGS. 4 and 6, and the core rod (stopper pin) (26) of the finger hook rings (R1) to (R5) is locked to both ends of the elongated blind hole (G) to be restrained not to come out from the lead-out window (24).

For the purpose of hooking the finger hook rings (R1) to (R5) on the user's limbs and fingers, the plurality of finger hook rings (R1) to (R5) may be all separated like independent rubber bands. However, in such a case, the finger hook rings (R1) to (R5) are all fallen apart to pieces, and the finger hook rings (R1) to (R5) cannot be quickly attached to the fitting (M) in an orderly and parallel state. Thus, the attachment workability and the stability of the attached state are poor. In addition, since the directions of the openings are random and easily entangled with each other, it is difficult to smoothly hook the finger hook rings (R1) to (R5) on the user's fingers and toes during use.

In this regard, when the elastic ring (R) of the cylindrical body (C) is arranged in a row as the plurality of finger hook rings (R1) to (R5) by cutting the slits (split grooves) (25) into the cylindrical body (C), the cylindrical body (C) is not completely cut off, and is kept in a state of forming a continuous single piece at the root portion (Rb).

In the illustrated examples, the elastic ring (R) of the cylindrical body (C) sliced into the constant widths (W5) (4 cm) is arranged in a row at equivalent constant widths (W7) (8 mm) as a total of five first to fifth finger hook rings (R1) to (R5) corresponding to five fingers or toes by cutting four slits (split grooves) (25) substantially in parallel to the cylindrical body (C), but the number of the finger hook rings (R1) to (R5) can be increased or decreased to be other than five, and the number of the finger hook rings (R1) to (R5) may be different between the pair of the elastic rings (R).

Further, the slits (split grooves) (25) are not limited to have the same cutting depth (D), and may be varied widely or narrowly in accordance with, for example, a change in the length of the five fingers or toes. Further, the finger hook rings (R1) to (R5) can have the widths (W7) varied widely or narrowly in accordance with, for example, a change in the thickness of the five fingers or toes.

In any case, when the fitting body board (15) and the lid board (16) of the fitting (M) are disassembled by removing the fixing screws (19), as suggested from FIG. 9, only the elastic ring (R) can be removed from the fitting (M) in the attached state in which the band (10) is passed through the fitting body board (15) and the lid board (16) and can be replaced with a new one.

In this case, the root portion (Rb) of the finger hook rings (R1) to (R5) of the elastic ring (R) may be set in a manner that the elastic ring (R) fixed and integrated with the core rod (26) may be removed from the fitting (M) to be replaceable with a new one by previously winding and bonding the root portion (Rb) to the core rod (26) and sandwiching the root portion (Rb) between the body board (15) and the lid board (16) of the fitting (M).

Figure 12:
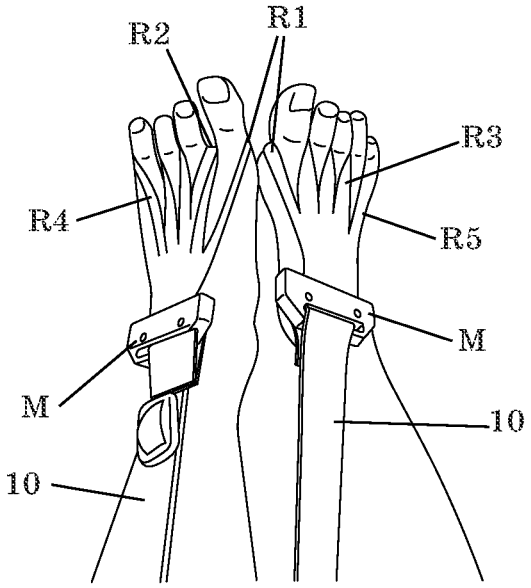
FIG. 12 is a front view illustrating an example of a hooked state of first to fifth finger hook rings on toes as viewed from a top side.
Figure 13:
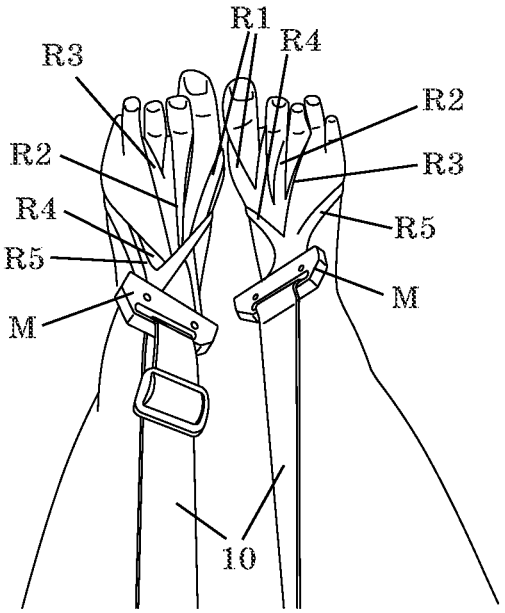
FIG. 13 is a front view illustrating another example of the hooked state as viewed from the top side of feet.
Figure 14:
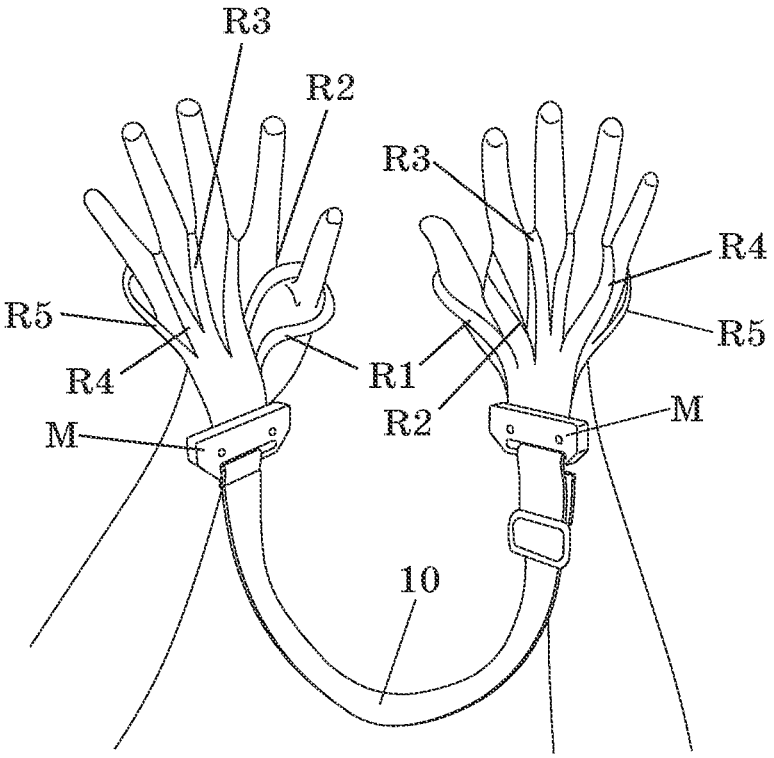
FIG. 14 is a front view illustrating an example of a hooked state of the first to fifth finger hook rings on hand fingers as viewed from a top side.

The stretch exercise tool (A) according to the preferred embodiment of the present invention has the above configuration, and the elastic ring (R) formed of the cylindrical body (C) having the constant width (W5) is divided and formed (branched) as a total of five first to fifth finger hook rings (R1) to (R5) arranged in parallel. Therefore, for example, as illustrated in FIGS. 12 to 14, the total of five first to fifth finger hook rings (R1) to (R5) can be hooked and used one by one separately on five toes (first to fifth toes), or appropriately selected five or less numbers of the finger hook rings can be hooked and used on the appropriately selected fingers or toes one by one separately or/and in a bundled state in which the finger hook rings are integrated into one ring shape (in this regard, in FIG. 13, the first to third finger hook rings (R1) to (R3) are hooked one by one separately on the first to third toes of a foot, and at the same time, the fourth and fifth finger hook rings (R4) and (R5) are bundled in one ring shape and hooked around a foot in a wound state). In addition, a total of five first to fifth finger hook rings (R1) to (R5) can be hooked and used one by one separately on five fingers (first to fifth fingers) of a hand. Thus, the stretch exercise tool (A) can be used for the stretching motions for various parts of the body as illustrated in FIGS. 15 to 32.

Note that, although not illustrated, the finger hook rings (R1) to (R5) may also be used by hooking the appropriately selected five or less numbers of the finger hook rings on the appropriately selected fingers of a hand also one by one separately or/and in a bundled state in which the finger hook rings are integrated into one ring shape in accordance with the use example of FIG. 13. In FIGS. 12 to 14, the finger hook rings (R1) to (R5) are hooked from the top side of hands and feet, but can also be hooked and used from the palm side or the back side of the feet.

Figure 15:
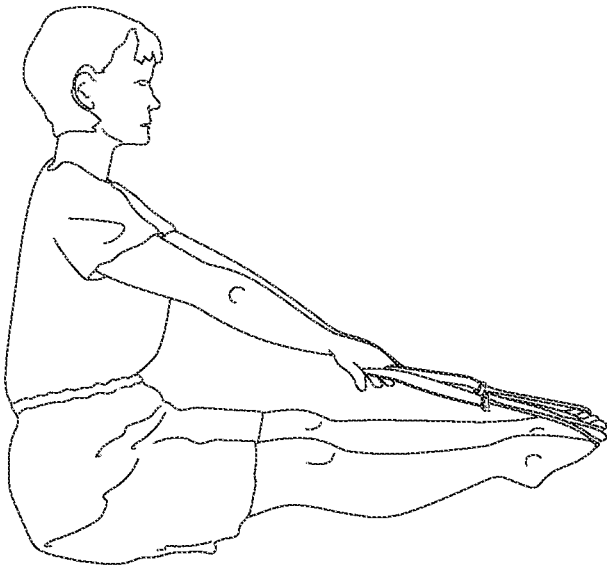
FIG. 15 is an external view illustrating a first use example of the stretch exercise tool.
Figure 16:
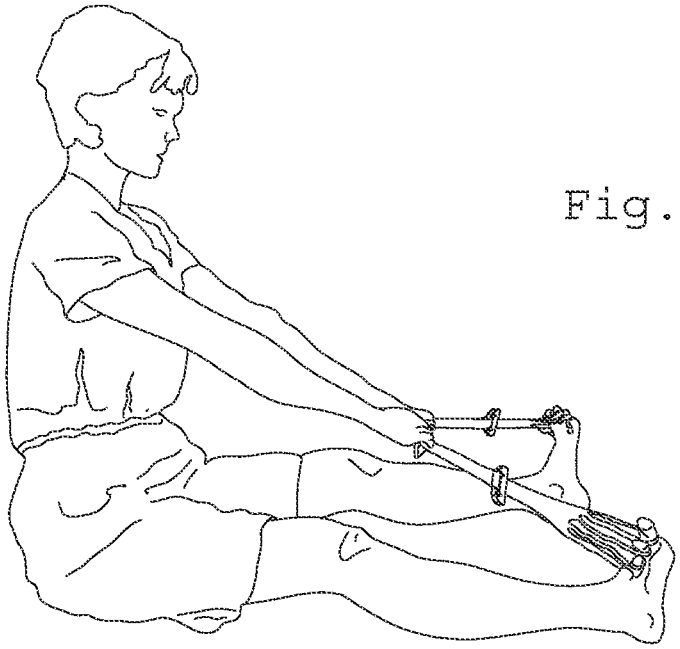
FIG. 16 is an external view illustrating a second use example of the stretch exercise tool.

Among various use examples illustrated in FIGS. 15 to 32, in FIGS. 15 and 16, for the muscle strengthening and stretching of the feet, the lower limbs, and the trunk, a total of five first to fifth finger hook rings (R1) to (R5) divided and formed (branched) as the pair of elastic rings (R) of the stretch exercise tool (A) is hooked one by one separately on the toes (first to fifth toes) of both of aligned or spread legs of a user sitting on the floor surface, and the band (10) is held by both hands and pulled.

Figure 17:
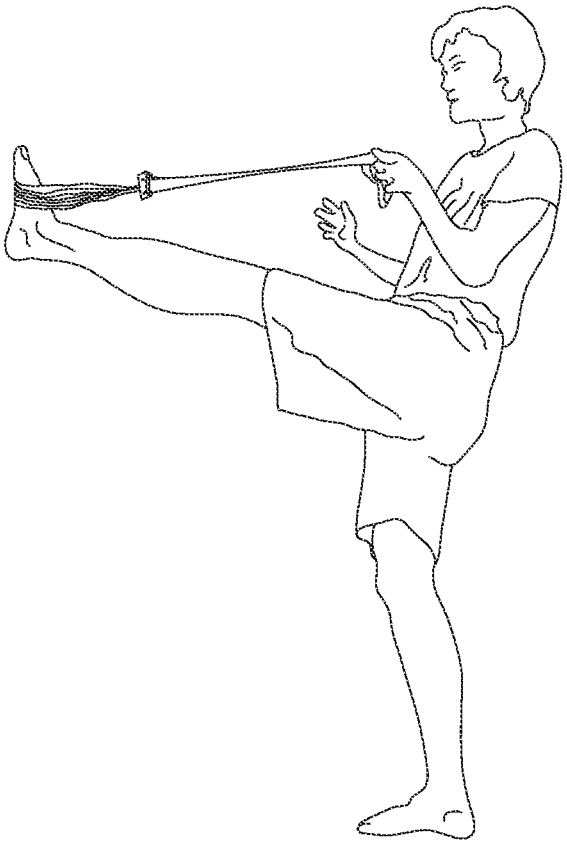
FIG. 17 is an external view illustrating a third use example of the stretch exercise tool.
Figure 18:
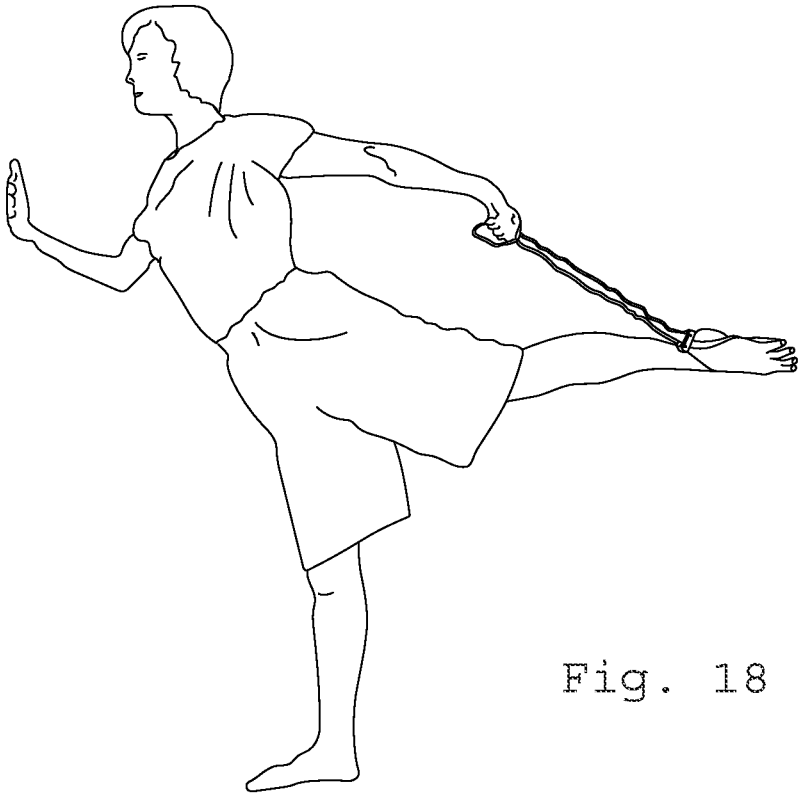
FIG. 18 is an external view illustrating a fourth use example of the stretch exercise tool.

In FIGS. 17 and 18, one of the first to fifth finger hook rings (R1) to (R5) forming the pair of elastic rings (R) is entirely hooked on the back side of one foot raised forward from the floor surface in a bundled state, and the other is entirely held and pulled by one hand as a grip in a bundled state, which is useful for the muscle strengthening and stretching of the feet, the lower limbs, and the trunk as well as the correction of widening the range of the hip joint motion.

Figure 19:
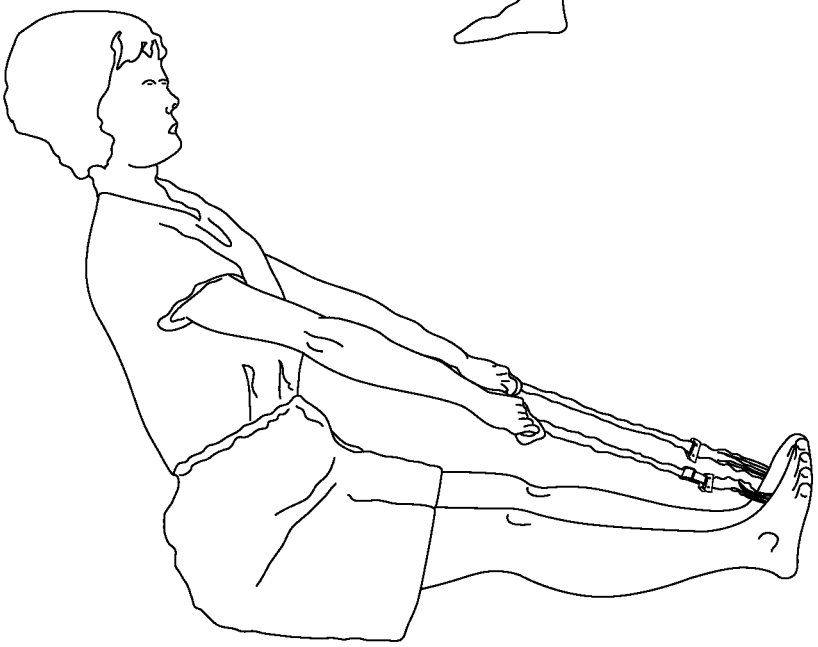
FIG. 19 is an external view illustrating a fifth use example of the stretch exercise tool.
Figure 20:
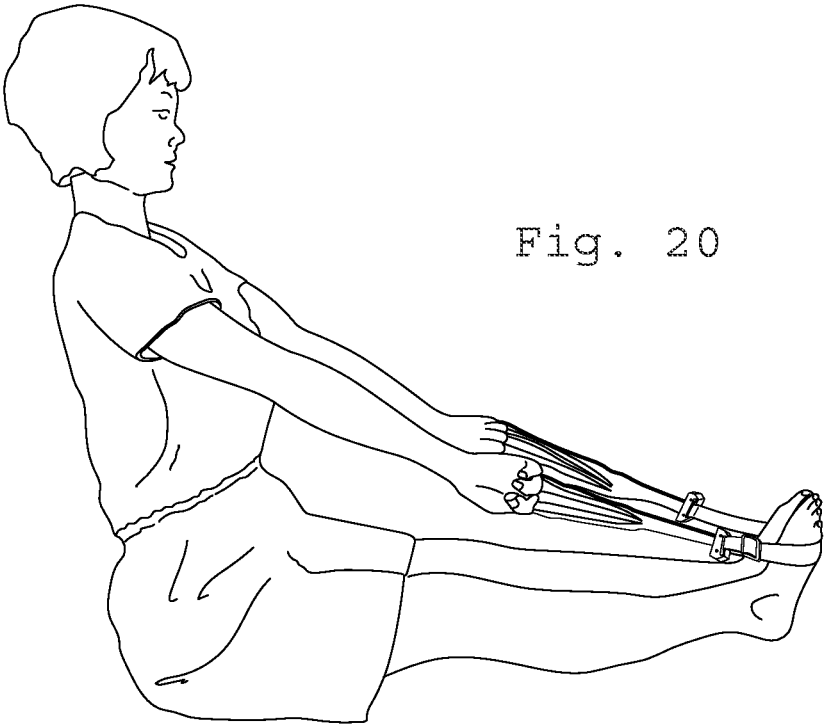
FIG. 20 is an external view illustrating a sixth use example of the stretch exercise tool.
Figure 21:
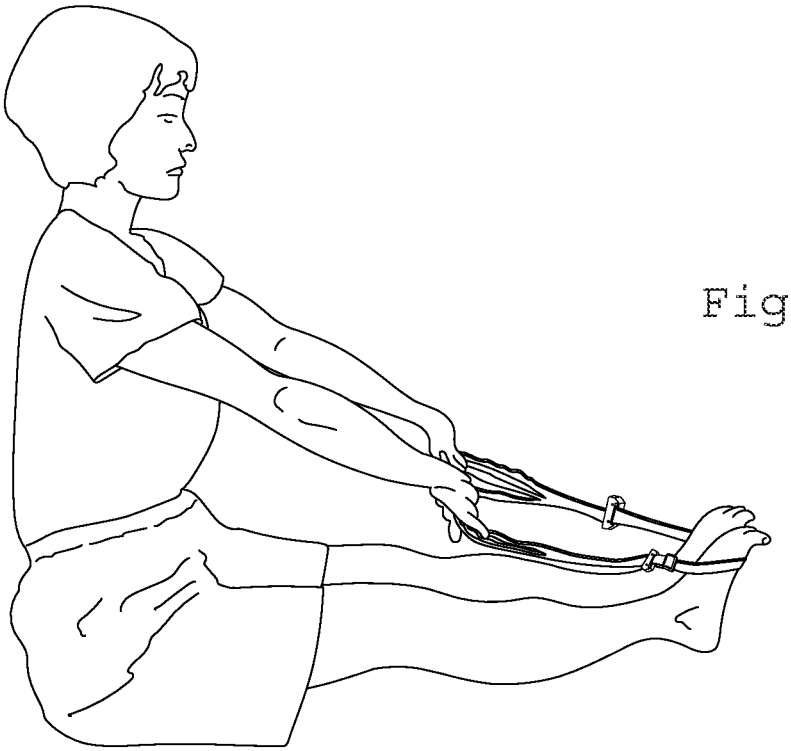
FIG. 21 is an external view illustrating a seventh use example of the stretch exercise tool.

In FIGS. 19 to 21, for the muscle strengthening and stretching of the hand fingers, the upper limbs, and the trunk, the band (10) of the stretch exercise tool (A) is hooked on the back side of aligned both legs of a user sitting on the floor surface in a wound state, and the pair of first to fifth finger hook rings (R1) to (R5) of the elastic ring (R) divided and formed (branched) is one by one separately hooked on the fingers (first to fifth fingers) of both hands and pulled.

Figure 22:
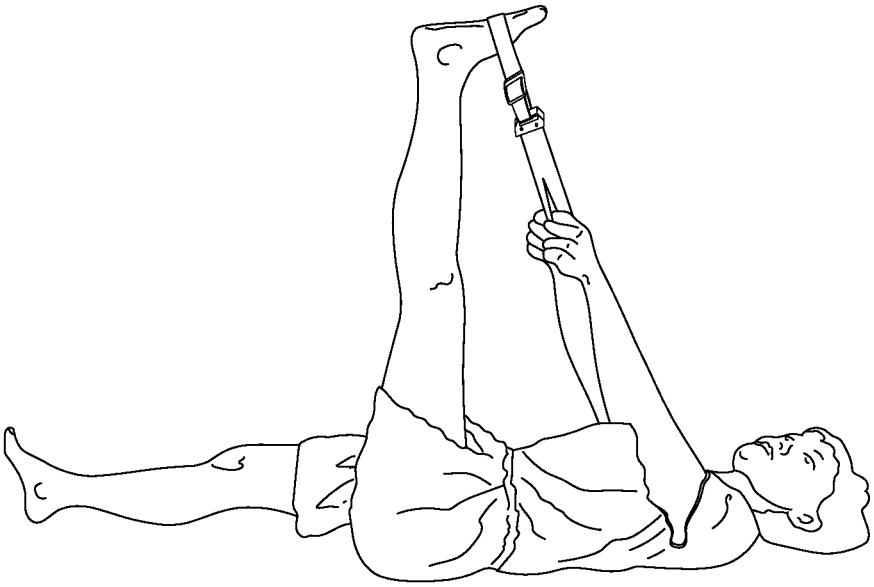
FIG. 22 is an external view illustrating an eighth use example of the stretch exercise tool.

In FIG. 22, for the muscle strengthening and stretching of the ankle joint, the lower limbs, and the upper limbs, the band (10) of the stretch exercise tool (A) is hooked around the back side of one leg lying down on the floor surface and raised in a wound state, and the entire pair of first to fifth finger hook rings (R1) to (R5) is used as a bundled grip by entirely being held and pulled by both hands.

Figure 23:
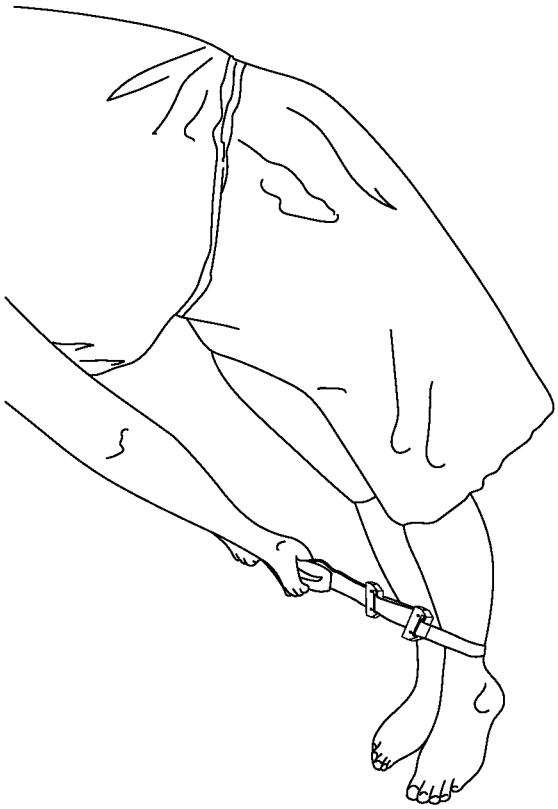
FIG. 23 is an external view illustrating a ninth use example of the stretch exercise tool.

In FIG. 23, in order to promote the blood flow of legs, the band (10) of the stretch exercise tool (A) is hooked around the vicinity of the ankles of both legs of a user standing on the floor surface in a wound state, and the entire pair of first to fifth finger hook rings (R1) to (R5) is used as a bundled grip by being entirely held and pulled by both hands to apply pressure (compression force) to the vicinity of the ankles.

Figure 24:
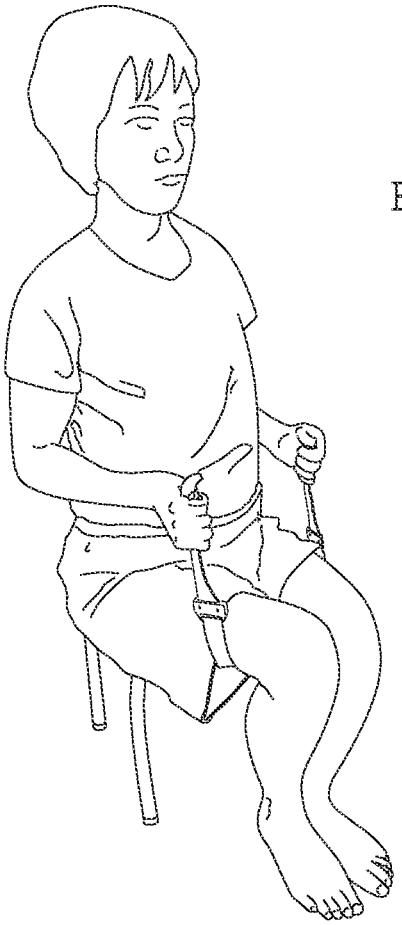
FIG. 24 is an external view illustrating a tenth use example of the stretch exercise tool.
Figure 25:
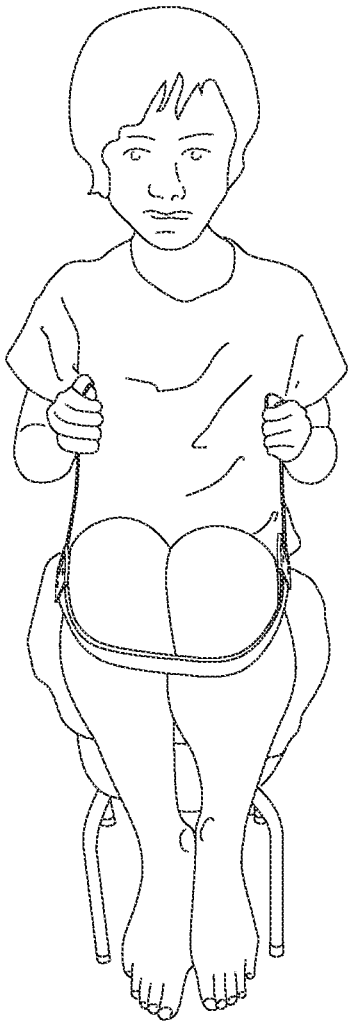
FIG. 25 is an external view illustrating an eleventh use example of the stretch exercise tool.
Figure 26:
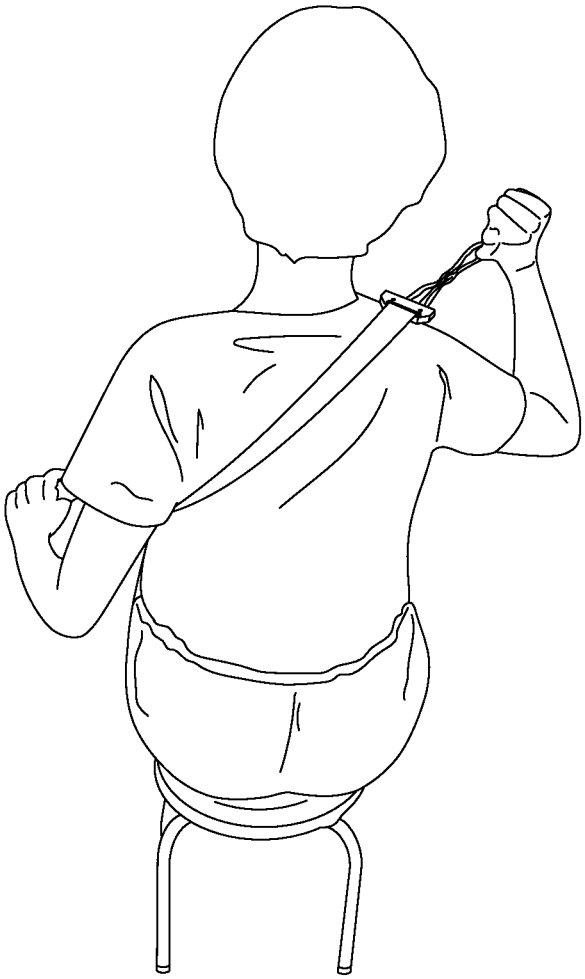
FIG. 26 is an external view illustrating a twelfth use example of the stretch exercise tool.

In addition, in FIGS. 24 to 26, for the muscle strengthening and stretching of the lower limbs and the trunk as well as the correction the hip joint and the posture, the band (10) of the stretch exercise tool (A) is hooked from the back side (lower side) of the thighs of both aligned legs of a user sitting on a chair, hooked from the front side to the vicinity of the knees, and hooked obliquely to the back, and the entire pair of first to fifth finger hook rings (R1) to (R5) is used as a bundled grip by being entirely held by both hands and pulled upward, forward, and backward.

Figure 27:
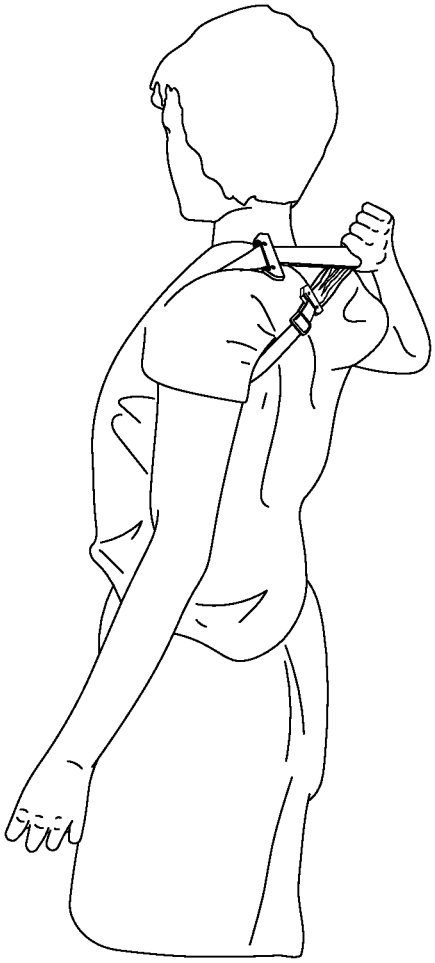
FIG. 27 is an external view illustrating a thirteenth use example of the stretch exercise tool.

In FIG. 27, for the correction of the shoulder joint, the band (10) of the stretch exercise tool (A) is hooked around one shoulder in a wound state, and the entire pair of first to fifth finger hook rings (R1) to (R5) is used as a bundled grip by being held and pulled together by one hand from the back.

Figure 28:
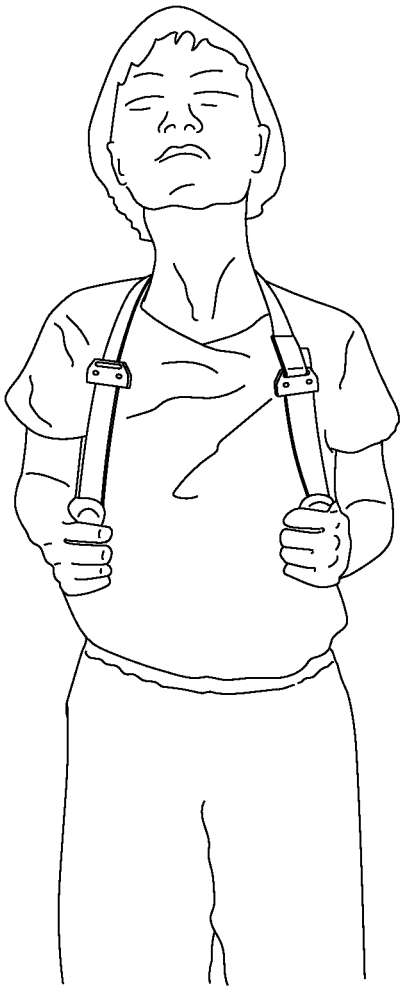
FIG. 28 is an external view illustrating a fourteenth use example of the stretch exercise tool.
Figure 29:
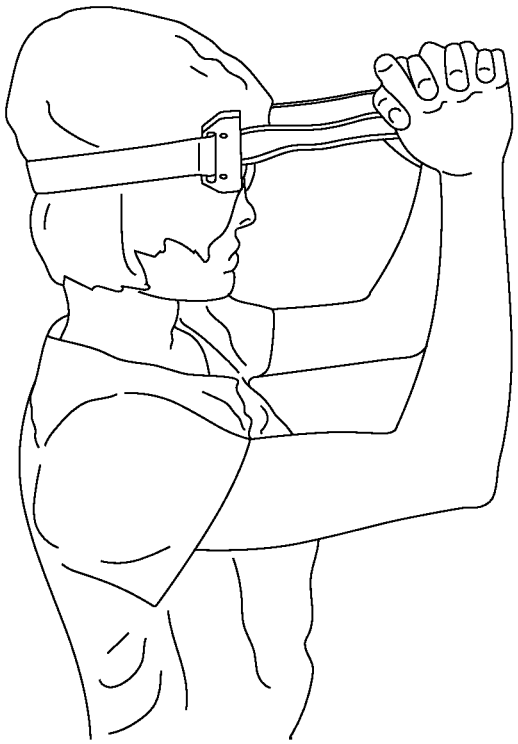
FIG. 29 is an external view illustrating a fifteenth use example of the stretch exercise tool.

In FIGS. 28 and 29, for the muscle strengthening and stretching of the neck and the trunk as well as the correction the posture, the band (10) of the stretch exercise tool (A) is hooked to the back of the neck and the entire pair of first to fifth finger hook rings (R1) to (R5) is used as a bundled grip by being held by both hands and pulled forward and downward, or the band (10) is hooked to the back of the head and the entire pair of first to fifth finger hook rings (R1) to (R5) is used as a bundled grip by being held together by both hands and pulled forward.

Figure 30:
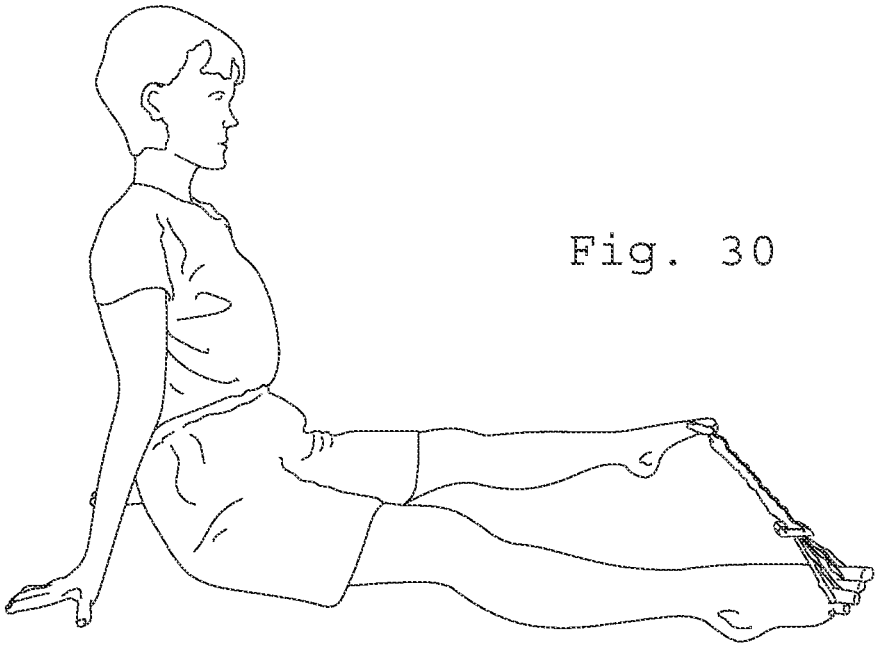
FIG. 30 is an external view illustrating a sixteenth use example of the stretch exercise tool.

In FIG. 30, for the muscle strengthening and stretching of the feet and the lower limbs, the pair of first to fifth finger hook rings (R1) to (R5) of the stretch exercise tool (A) is one by one separately hooked on the toes (first to fifth toes) of both spread legs of a user sitting on the floor surface, and pulled in the opposite right and left (lateral) directions by the both legs.

Figure 31:
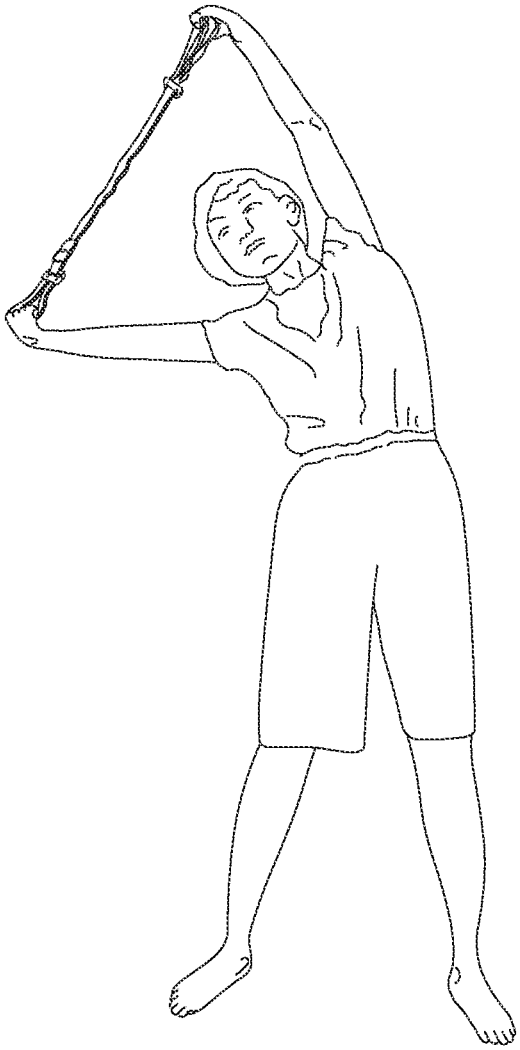
FIG. 31 is an external view illustrating a seventeenth use example of the stretch exercise tool.
Figure 32:
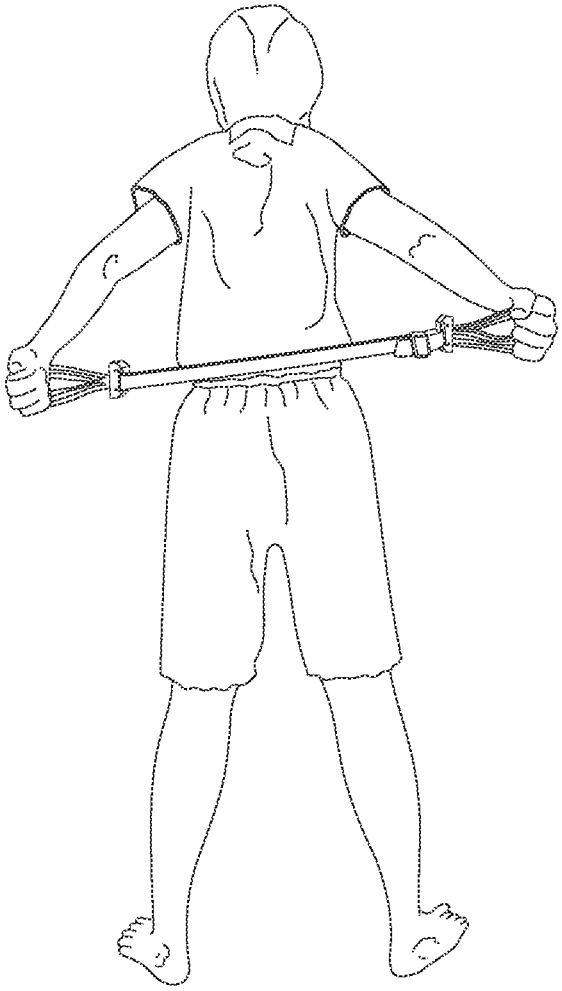
FIG. 32 is an external view illustrating an eighteenth use example of the stretch exercise tool.

Furthermore, in FIGS. 31 and 32, for the muscle strengthening and stretching of the upper limbs and the trunk, the pair of first to fifth finger hook rings (R1) to (R5) of the stretch exercise tool (A) is used as a grip, and each of the finger hook rings is separately hooked on the five fingers of both hands, or the five finger hook rings are integrated and hooked on the five fingers of both hands in a bundled state, and the grips are pulled in the opposite right and left (lateral) directions while being held in both hands raised above or both hands directed to the back.

As can be seen from the above use examples, with respect to the first to fifth finger hook rings (R1) to (R5) of the stretch exercise tool (A) according to the illustrated embodiment, the total of five finger hook rings are one by one separately hooked on the fingers and toes, or hooked to be wound around the foot as a bundled state in which the five finger hook rings are integrated into one ring shape. In addition, similarly, the bundled state in which the five finger hook rings are integrated into one ring shape is used as a grip so to speak, and the grip is held by one hand or both hands (total of the five finger hook rings are wound around and hooked on the holding hand). Even when such a total of five first to fifth finger hook rings (R1) to (R5) are used as a grip, the finger hook rings (R1) to (R5) themselves still exhibit stretchability and rubber-like elasticity, and the tensile force of the first to fifth finger hook rings (R1) to (R5) directly acts on the hand holding the grip.

In any case, the finger hook rings (R1) to (R5) of the elastic rings (R) of the stretch exercise tool (A) are attached to both ends of the band (10) via the fittings (M), and smoothly stretch and elastically deform. On the other hand, the band (10) is a textile product such as a flexible woven fabric (fabric) that does not stretch but can fit the body, and the use length can be adjusted by the buckle (12).

Therefore, if the user of the exercise tool (A) pulls the finger hook rings (R1) to (R5) rich in stretchability and rubber-like elasticity during the stretching exercise described in the above use examples, the limbs and the fingers and toes that are hooked in the wound state are elastically tightened, and capillaries of the limbs and the fingers and toes are elastically compressed. On the other hand, when the pulling is returned to the original state, the compression of the blood vessels is instantaneously released. By repeatedly applying such stimulation (massage), the peripheral blood flow can be spontaneously promoted, and good circulation of blood can be obtained.

In addition, the compression and release of the capillaries are performed by the resilient force (flicking action) of the finger hook rings (R1) to (R5), and even if the finger hook rings (R1) to (R5) are pulled excessively strongly, there is no risk of causing an intolerable pain to the hooked limbs or fingers and toes or damaging the skin, and anyone can use the stretch exercise tool (A) safely.

Note that the stretch exercise tool (A) of the present invention is not limited to stretch exercise tools for the users themselves as illustrated in FIGS. 15 to 32, and can be used by a guardian for correcting the posture of a child, strengthening and stretching the muscles of the trunk, and the like, or can be used by an owner or an animal hospital for rehabilitation of pet animals, correcting ankle joints, and the like.

What is claimed is:

1. A stretch exercise tool comprising:

a non-stretchable flexible band capable of adjusting a use length, the flexible band having a first end and a second end opposite to the first end of the flexible band, the first end of the flexible band having a first stretchable elastic ring coupled thereto via a first fitting, the second end of the flexible band having a second stretchable elastic ring coupled thereto via a second fitting, wherein the first elastic ring is obtained by slicing a first rubber or thermoplastic elastomer tube having a first cylindrical body and a first constant width, the second elastic ring is obtained by slicing a second rubber or thermoplastic elastomer tube having a second cylindrical body and a second constant width, the first elastic ring includes a plurality of finger hook rings that are formed by cutting slits in the first elastic ring, wherein the slits extend partially across a length of the first elastic ring from a first end of a circumferential surface of the first cylindrical body with the first constant width and not reaching a second end of the circumferential surface of the first cylindrical body, wherein the second end of the circumferential surface is opposite to the first end of the circumferential surface, wherein the first end of the circumferential surface is divided and the second end of the circumferential surface is not divided, and the second end of the undivided circumferential surface is sandwiched in a retaining state by the first fitting as a root portion of a continuous single piece common to the plurality of finger hook rings.

2. The stretch exercise tool according to claim 1, wherein the plurality of finger hook rings includes five finger hook rings arranged in parallel and formed by cutting four slits substantially in parallel into the cylindrical body having the constant width of each respective ring.

3. The stretch exercise tool according to claim 1, wherein the root portion of the continuous single piece common to the plurality of finger hook rings is wound around a core rod longer than the constant width of the first cylindrical body, and the core rod around which the root portion is wound is sandwiched in the retaining state by the first fitting.

4. The stretch exercise tool according to claim 1, wherein the widths of the plurality of finger hook rings are all equal or are varied widely or narrowly in accordance with a change in thickness of a finger in a limb.

5. The stretch exercise tool according to claim 1, wherein the cut depths of the slits dividing and forming the plurality of finger hook rings are all equal or are varied deeply or shallowly in accordance with a change in length of a finger or a limb.

6. The stretch exercise tool according to claim 1, wherein each of the fittings is formed of a fitting body board and a lid hoard having a same size and shape and fastened and fixed by a plurality of fixing screws, a through hole of the band is penetrated and formed on one end side with a fixing position by the fixing screws as a boundary, and on the other end side with the fixing position by the fixing screws as the boundary, recessed grooves that communicate with each other to form a blind hole is notched and formed in a manner that the root portion of the continuous single piece common to the plurality of finger hook rings can be sandwiched in the retaining state.

7. The stretch exercise tool according to claim 6, wherein the elastic rings are configured to be detachable and replaceable in an attached state in which the band is passed through the fitting body board and the lid board by removing the fixing screws fastening and fixing the body board and the lid board of the fittings.

8. The stretch exercise tool according to claim 6, wherein the body board and the lid board of the fittings are made of an alloy, a metal, a fiber-reinforced resin, or a synthetic resin.

* * * * *